US006978728B2

(12) United States Patent
Koop et al.

(10) Patent No.: US 6,978,728 B2
(45) Date of Patent: Dec. 27, 2005

(54) ACTIVE ROLL STABILIZATION SYSTEM FOR SHIPS

(75) Inventors: Mattheus Theodorus Koop, Oud-Turnhout (BE); Lambertus Johannes Maria Dinnissen, Eindhoven (NL)

(73) Assignee: Quantum Controls B.V., Nuth (NL)

( * ) Notice: Subject to any disclaimer, the term of this patent is extended or adjusted under 35 U.S.C. 154(b) by 0 days.

(21) Appl. No.: 10/890,946

(22) Filed: Jul. 14, 2004

(65) Prior Publication Data

US 2005/0145151 A1 Jul. 7, 2005

(30) Foreign Application Priority Data

Jul. 15, 2003 (NL) ..... 1023921

(51) Int. Cl.[7] ..... B63B 39/06
(52) U.S. Cl. ..... 114/126; 114/122
(58) Field of Search ..... 114/122, 126

(56) References Cited

U.S. PATENT DOCUMENTS 3,757,723 A 9/1973 Pangalila
5,171,623 A 12/1992 Yee
5,445,095 A 8/1995 Bushnell et al.

FOREIGN PATENT DOCUMENTS

EP 0754618 1/1997

OTHER PUBLICATIONS

Page 1 of esp@cenet database printout giving English translation of the Abstract for EP0754618 in the name of HAVRE, Chantiers.

*Primary Examiner*—Jesus D. Sotelo
(74) *Attorney, Agent, or Firm*—Hovey Williams LLP

(57) ABSTRACT

The invention relates to an active roll stabilisation system for ships, comprising at least one rotatable stabilisation element extending below the water line, sensor means for sensing the ship's movements and delivering control signals on the basis thereof to driving means for rotating the stabilisation element for the purpose of damping the ship's movements that are being sensed.

The object of the invention is to provide an active roll stabilisation system for ships that can be used both while the ship is sailing and while the ship is at anchor. According to the invention, the active roll stabilisation system is to that end characterized in that the system furthermore comprises displacement means for moving the stabilisation element with respect to the ship. This makes it possible to create a relative movement of the rotating stabilisation element with respect to the water both while the ship is sailing and while the ship is at anchor, so that the Magnus effect will occur at all times and the correction force thus being generated can be utilised for damping the ship's movements that are being sensed.

23 Claims, 6 Drawing Sheets

ACTIVE ROLL STABILIZATION SYSTEM FOR SHIPS

The invention relates to an active roll stabilisation system for ships, comprising at least one rotatable stabilisation element extending below the water line, sensor means for sensing the ship's movements and delivering control signals on the basis thereof to driving means for rotating the stabilisation element for the purpose of damping the ship's movements that are being sensed.

Such an active roll stabilisation system for ships is known, for example from U.S. Pat. No. 3,757,723. In said U.S. patent it is proposed to rotate a stabilisation element that projects into the water from the ship's hull below the waterline about its longitudinal axis so as to compensate for the rolling motions that the ship undergoes while sailing. To that end, the ship is fitted with sensor means, for example angle sensors, speed sensors and acceleration sensors, by means of which the angle, the rate of roll or the roll acceleration are sensed. Control signals are generated on the basis of the data being obtained, which signals control the rotation of the rotatable stabilisation element as regards the direction of rotation and the speed of rotation.

A correction force is generated under the influence of the rotary motion of the stabilisation element and the water flowing past while the ship is sailing, which correction force is exerted in a direction perpendicularly to the direction of rotation of the stabilisation element and the direction of movement of the water flowing past. This physical phenomenon is also referred to as the Magnus effect, on the basis of which the correction force is used for opposing the ship's roll.

A drawback of the stabilisation system according to said U.S. patent is that it is fairly static as regards its control and that it can only be used while the ship is sailing. The above-described Magnus effect does not occur while the ship is at anchor, because there is no movement of water past the rotating stabilisation elements, which movement generates the correction force as a result of the Magnus effect.

The object of the invention is therefore to provide an active roll stabilisation system for ships that can be used both while the ship is sailing and while the ship is at anchor. According to the invention, the active roll stabilisation system is to that end characterized in that the system furthermore comprises displacement means for moving the stabilisation element with respect to the ship. This makes it possible to create a relative movement of the rotating stabilisation element with respect to the water both while the ship is sailing and while the ship is at anchor, so that the Magnus effect will occur at all times and the correction force thus being generated can be utilised for damping the ship's movements that are being sensed.

More particularly, the active roll stabilisation system according to the invention can be used very well if the moving stabilisation element comprises a motion component in the longitudinal direction of the ship.

In a special embodiment, the system according to the invention is characterized in that the displacement means impart a translating movement with respect to the ship to the stabilisation element, in which embodiment the stabilisation element is accommodated in a guide mounted in or on the ship's hull.

To provide an optimum damping of the ship's movements that are being sensed, the guide extends at least partially in the longitudinal direction of the ship. The moving stabilisation element thus comprises a motion component in the longitudinal direction of the ship.

Another embodiment of the active roll stabilisation system according to the invention, by means of which sensed motion (in particular rolling motion) of the ship can be effectively damped both while the ship sailing and while the ship is at anchor, is characterized in that the displacement means impart a pivoting movement with respect to the ship to the stabilisation element. In said embodiment, the stabilisation element is connected to the ship by means of a universal joint, so that pivoting and/or rotating movement of the stabilisation element through the water with respect to the ship is possible.

In a specific embodiment of this aspect of the invention, the stabilisation element can be accommodated in a recess formed in the ship's hull, so that the stabilisation element can be retracted in the ship's hull while the ship is sailing, if desired, as a result of which the friction between the ship and the water significantly decreases while the ship is sailing.

Another specific embodiment of the stabilisation system according to the invention, in which the stabilisation element can likewise make a pivoting and/or rotating movement with respect to the ship, is characterized in that the displacement means comprise at least one arm, to which the stabilisation element is mounted, which arm is connected to a ship, likewise by means of a universal joint.

A functional embodiment of the stabilisation element to be used in the active roll stabilisation system according to the invention is characterized in that the stabilisation element comprises at least one rotatable, elongated shaft.

An embodiment derived from the preceding embodiment may comprise two rotatable, elongated, interconnected shafts positioned some distance apart.

More particularly, according to this latter aspect the two shafts may be interconnected by means of an endless carrier mounted over the shafts.

All the above the embodiments of the stabilisation element to be used in the active roll stabilisation system according to the invention are functionally very suitable for use in particular with ships being at anchor. The movements of the ship being at anchor can be damped very effectively when using these embodiments, because the well-known Magnus effect occurs with ships being at anchor as well.

Other effective embodiments of the stabilisation element according to the invention are characterized in that the stabilisation element is spherical, cylindrical, conical or oval in shape.

An improved effectiveness of the rotating stabilisation element for damping the ship's roll, especially if the ship is at anchor, can be achieved if the stabilisation element has a roughened outer surface. More particularly, in a very usable embodiment of the stabilisation element, the outer surface of the stabilisation element comprises a large number of indentations.

This aspect of a roughened outer surface (possibly in the form of indentations) has an advantageous effect on the flow profile of the water flowing past the stabilisation element during stabilisation of the ship's roll.

The roughened profile of the stabilisation element provides a longer circumfluence through the water and prevents premature separation of the flow profile from the outer surface of the stabilisation element. This effect results in an increasing lifting power of the stabilisation element and consequently in an improved counteraction against the ship's movements that are being sensed.

To improve the effectiveness of the moving and rotating stabilisation element in use, and in particular to prevent so-called disadvantageous hydrodynamic effects in the longitudinal direction of the stabilisation element (for example tip turbulence), the stabilisation element is according to the invention provided with at least one plate extending perpendicularly to the axis of rotation. In a specific embodiment, the plate is mounted to the free end of the stabilisation element.

According to the invention, a further improvement of said embodiment, and consequently a positive effect on the hydrodynamic behaviour of the stabilisation element moving through the water, is characterized in that the plate is mounted to the free end of the stabilisation element by means of a bearing.

The plate is thus freely movable on the stabilisation element and will hardly rotate along with the stabilisation element during operation. The plate will not rotate through the water, it will only move or cut through the water and consequently it will not have an adverse effect on the behaviour of the stabilisation element. The hydrodynamic behaviour of the stabilisation element, on the other hand, is improved, because the risk of tip turbulence occurring at the free end of the stabilisation element is thus eliminated.

According to the invention, it is furthermore preferable to provide the stabilisation element according to the invention on either longitudinal side of the ship.

The invention will now be explained in more detail with reference to a drawing, in which.

Figure 1:
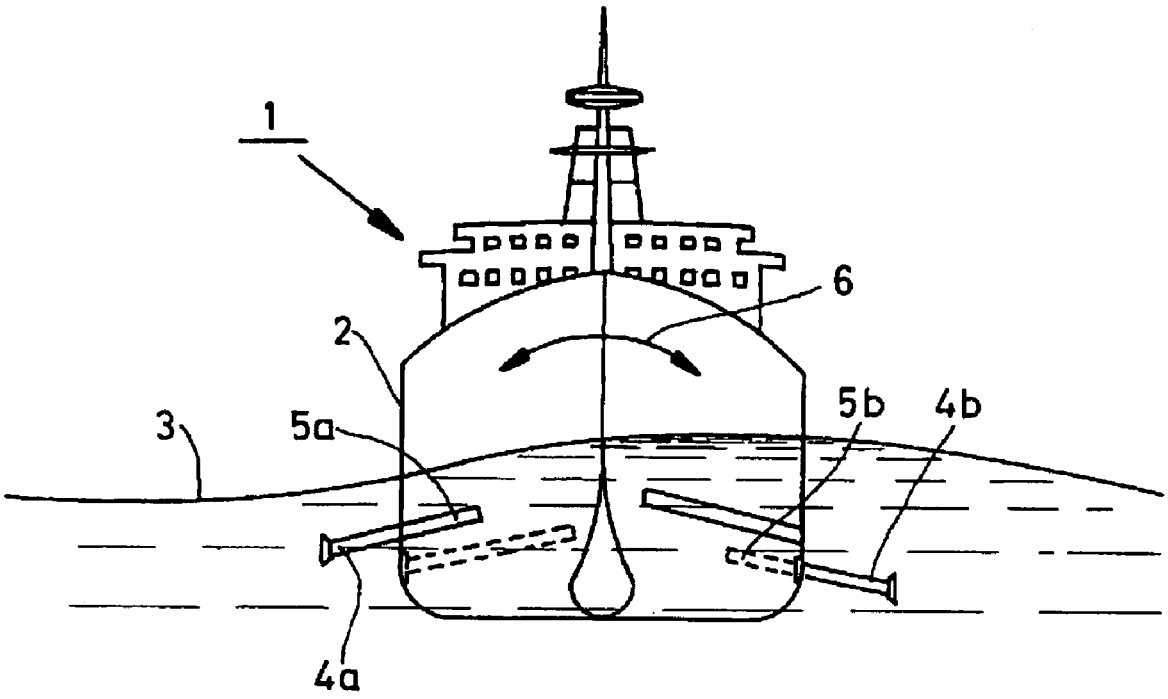
FIG. 1 is a view of a ship fitted with an active roll stabilisation system according to the prior art.

In FIG. 1 an active roll stabilisation system according to the prior art is shown. The ship 1 floating on the water surface 3 is fitted with an active roll stabilisation system indicated by reference numerals 4*a* and 4*b*. This known active roll stabilisation system for ships as described in U.S. Pat. No. 2,757,723 is comprised of rotatable stabilisation elements 4*a* and 4*b*, respectively, which extend from a respective longitudinal side of the hull 2 of the ship below the water line.

The prior art active roll stabilisation system also comprises sensor means (not shown) for sensing the ship's movements, more in particular the ship's roll as indicated at 6. On the basis of the sensing results, control signals are delivered to driving means (likewise not shown), which rotate either one of the stabilisation elements 4*a* or 4*b* (depending on the required correction). Said sensor means may consist of angle sensors, speed sensors or acceleration sensors, which continuously sense the angle of the ship relative to the horizontal water surface 3 and the speed or the acceleration caused by the ship's rolling motions 6.

The active roll stabilisation system as shown in FIG. 1 is intended to damp the ship's motions while sailing, i.e. during movement of a ship in its longitudinal direction (head on in FIG. 1). The interaction between the rotating stabilisation element 4*a* or 4*b* and the water flowing past results in a reaction force perpendicular to the direction of rotation and also perpendicular to the direction of movement of the water (or the ship) as a result of the so-called Magnus effect. Said Magnus forces may be used as correction forces for correcting the rolling motion 6 and consequently for stabilising the ship 1.

A very important drawback of the currently known active roll stabilisation systems that operate on the basis of the Magnus effect is the fact that at present they can only be used with ships that are actually sailing. At present no stabilisation system is available that can be used with ships that are mainly at anchor. It is especially for this latter group of ships (for example charter ships being at anchor in a bay for a prolonged period of time) that the present invention is very suitable and readily usable.

Figure 2A:
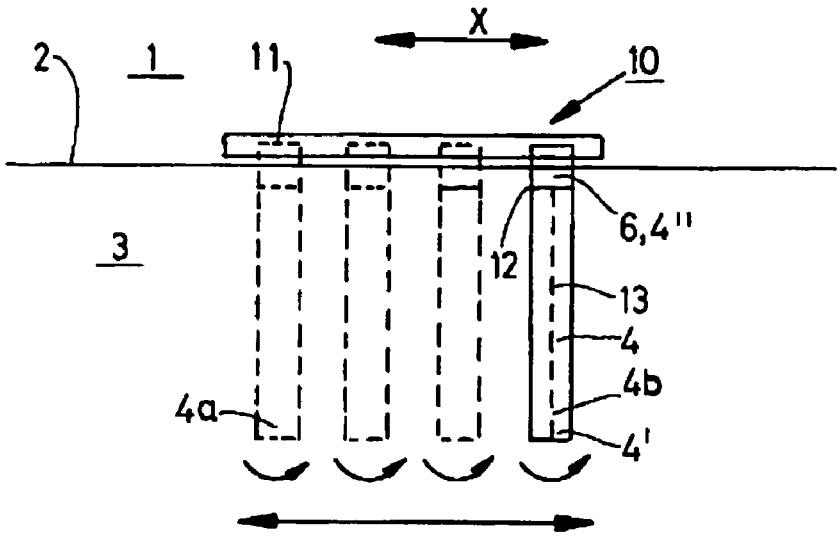
FIGS. 2A–2B are views of a first embodiment of an active roll stabilisation system according to the invention.

In FIG. 2A a first embodiment of the active roll stabilisation system according to the invention is shown. Insofar as is necessary for a better understanding of the invention, those parts that correspond to parts shown in FIG. 1 are indicated by the same reference numerals.

According to the invention, the active roll stabilisation system comprises displacement means which move the rotatable stabilisation element 4 with respect to the ship. More particularly, FIG. 2A shows an embodiment in which the displacement means 10 impart a reciprocating translating movement between two extreme positions $\mathbf{4}_a$ and $\mathbf{4}_b$ to the stabilisation element, in such a manner that said movement comprises at least one component in the longitudinal direction of the ship. The longitudinal direction of the ship is indicated by the wide arrow X in FIG. 2A.

With the translating embodiment of the active roll stabilisation system according to the invention as shown in FIG. 2A (see also FIG. 2B), translating movement of the rotatable stabilisation element 4 is possible in that a guide 11 is mounted in the hull 2 of the ship 1, along which guide the stabilisation element 4 can move. To that end, the rotatable stabilisation element 4 is accommodated in the guide 11 with its one end 4" by means of a universal joint 12, thus enabling translating movement in the guide 11 as well as rotary motion about the longitudinal axis 13.

Although this is schematically illustrated in the figure, the rotatable stabilisation element 4 is connected by means of a universal joint 12 to the driving means 6, which rotate the stabilisation element 4 for the purpose of damping the ship's motion that is being sensed. In this embodiment, the assembly of the driving means 6 and the universal joint 12 (which enables the stabilisation element 4 to rotate with respect to the driving means 6 and the ship 1) can translate along the guide 11, for example by means of a rack-and-pinion transmission mechanism.

Also other translating transmission mechanisms may be used for this purpose, however.

The reciprocating translation of the rotatable stabilisation element 4 between the extreme positions $\mathbf{4}_a$ and $\mathbf{4}_b$ in the guide 11 in the longitudinal direction X of the ship 1 combined with the rotation of the stabilisation element 4 results in a reactive force, also referred to as the Magnus force. Said force extends perpendicularly both to the direction of movement of the stabilization element 4 in the X-direction and to the direction of rotation.

Depending on the direction of the ship's motion (the ship's roll) that is to be damped, the direction of rotation of the stabilisation element 4 must be selected such that the resulting Magnus force $F_M$ opposes the rolling force $F_R$ being exerted on the ship by the ship's rolling motion.

Figure 2B:
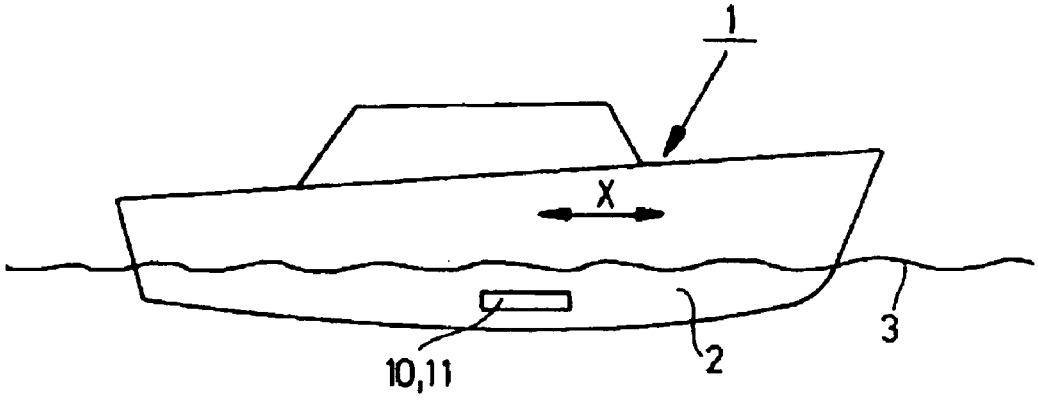

This is shown in the FIG. 3, in which the translating, rotatable stabilisation elements 4*a*–4*b* are disposed below the waterline 3, near the centre of the ship (see FIG. 2B). The direction, the speed as well as the acceleration of the rolling motion can be sensed in a manner which is known per se by means of suitable sensor means (angle sensor, speed sensor and acceleration sensor). On the basis of the sensing results, control signals are delivered to the respective driving means 6 and 10. On the basis of said signals, the driving means 6 will drive the stabilisation element 4 at a speed and in a direction that may or may not be varied, whilst also the displacement means 10 will move the rotating stabilisation element 4 in the longitudinal direction X in the guide 10 at a certain speed.

Figure 4:
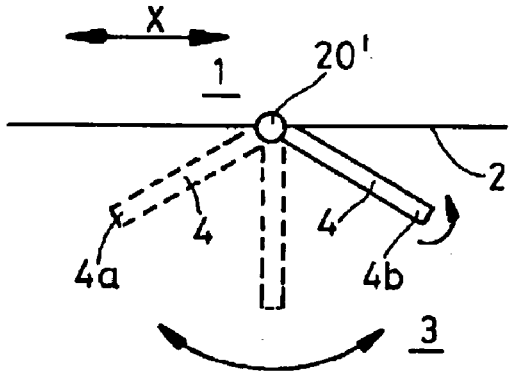
FIG. 4 is a view of a second embodiment of an active roll stabilisation system according to the invention.

In FIG. 4 another embodiment of the active roll stabilisation system according to the invention is shown, wherein the displacement means (indicated at 20 in this figure) impart a reciprocating pivoting movement between two extreme positions $\mathbf{4}_a$ and $\mathbf{4}_b$ with respect to the ship 1 to the stabilisation element 4. In order to ensure that the active roll stabilisation system will function correctly, in particular with ships being at anchor, the pivoting movement that is imparted to the rotatable stabilisation element 4 by the displacement means 20 preferably comprises at least one motion component in the longitudinal direction X of the ship in the embodiment as shown in FIG. 4, too.

Using the above arrangement and a suitable control and drive of the stabilisation element 4 in terms of speed and direction of rotation and speed and direction of pivoting, the Magnus effect will also occur with a ship that is at anchor, resulting in a Magnus force $F_M$ comprising at least one force component directed towards or away from the water surface 3. Said upward or downward force component of the Magnus force $F_M$ can be utilised very effectively for compensating the rolling motion of the anchored ship about its longitudinal axis X.

Figure 5A:
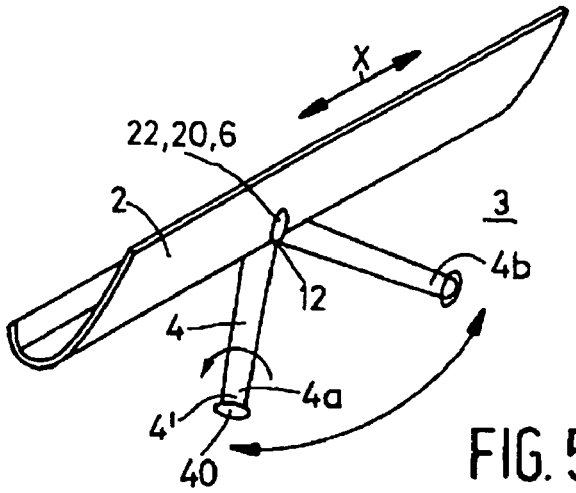
FIGS. 5A–5E are detail views of the embodiment that is shown in FIG. 4.
Figure 5B:
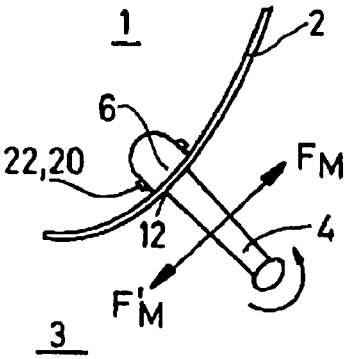

FIGS. 5A–5E show detail views of the pivoted embodiment of the active roll stabilisation system as shown in FIG. 4. In this case, too, like parts are indicated by the same numerals. FIG. 5A is another view of FIG. 4, in which the rotatable stabilisation element 4 is connected, again by means of a universal joint 12 (see in particular FIGS. 5B, 5D and 5E), to the displacement means 20, which, together with the driving means 6 for the rotational drive, impart a reciprocating pivoting movement between two extreme positions $\mathbf{4}_a$ and $\mathbf{4}_b$ about the pivot axis 22 of the stabilisation element 4.

Figure 5C:
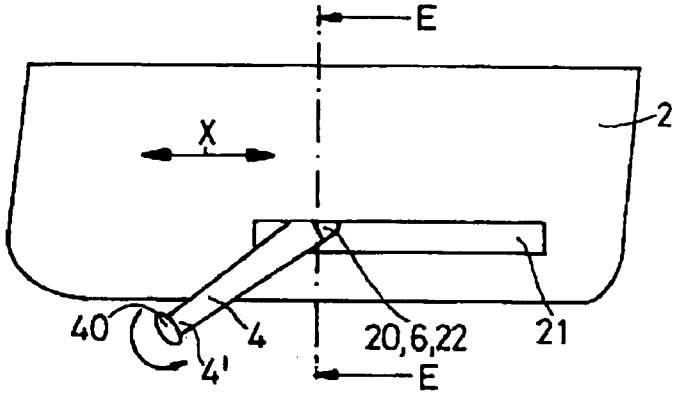
Figure 5D:
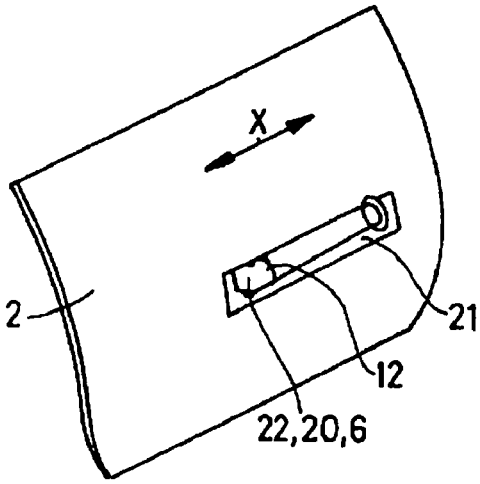
Figure 5E:
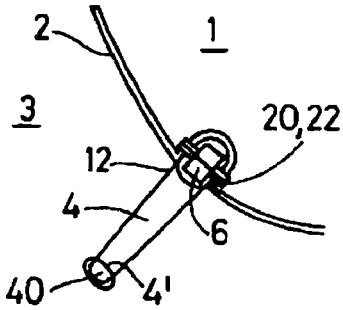

As FIGS. 5C and 5D show, the pivotable and rotatable stabilisation element of this embodiment can be swung away or be accommodated in a recess 21 formed in the ship's hull 2. This is a functional embodiment in particular in a situation in which the ship is no longer at anchor but is about to sail, in which situation the use of this embodiment is not functional. To reduce the frictional resistance while the ship is sailing, it may be desirable to swing the stabilisation element 4 back to a position in which it is accommodated in the recess 21.

Figure 6A:
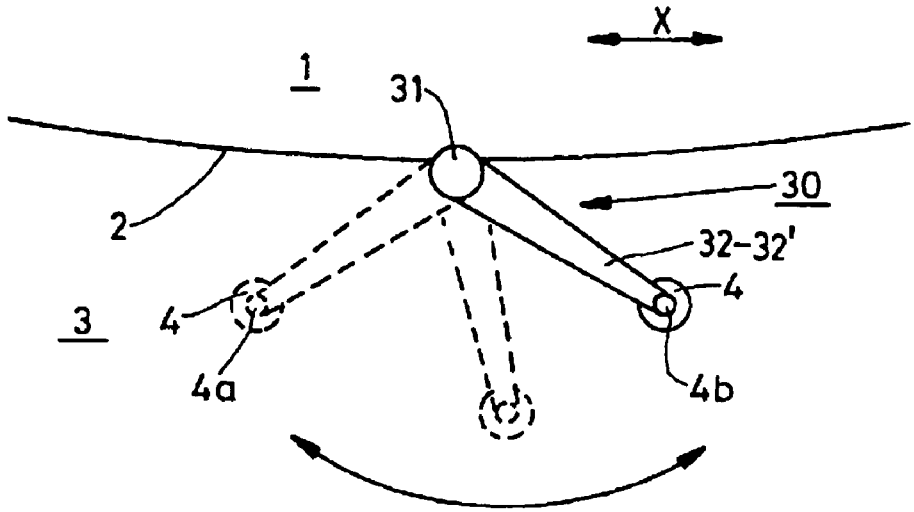
FIGS. 6A–6B are views of a third embodiment of an active roll stabilisation system according to the invention.
Figure 6B:
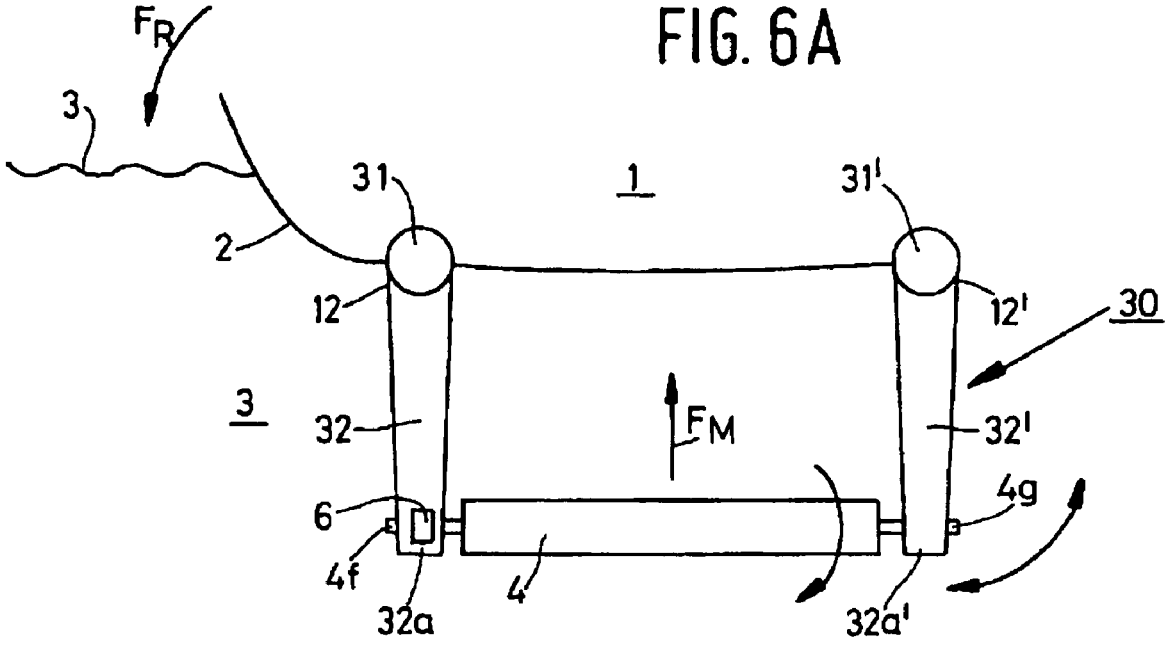

FIGS. 6A and 6B show another pivoted embodiment of the active roll stabilisation system according to the invention, in which embodiment the rotatable stabilisation element 4 is rotatably accommodated with its two ends 4*f*–4*g* between the free ends 32*a*–32*a*' of two arms 32–32', which are each connected to the ship's hull 2 by means of a universal joint 12–12'.

The driving means 6 for rotatably driving the stabilisation element 4 may be accommodated in one arm or in both arms 32–32', whilst the displacement means 31–31' impart a pivoting (in this case comparable to a swinging) rotary motion between two extreme positions $\mathbf{4}_a$ and $\mathbf{4}_b$ to the stabilisation element 4. In this embodiment, too, this configuration will lead to a resulting or correcting Magnus force $F_M$ in the case of a ship being at anchor, which force comprises an upward or a downward force component, depending on the direction of rotation or of pivoting of the assembly 30, which force component is used for correcting or damping a force $F_R$ being exerted on the ship 1 as a result of the ship's roll.

The control used in the active roll stabilisation system in general and in the illustrated embodiments in particular is such that the stabilisation element, rotating in a first direction of rotation, undergoes a complete movement between its two extreme positions $\mathbf{4}_a$ and $\mathbf{4}_b$ (refer to the figures) during the sinusoidal rolling movement of the ship.

In the case of a rolling movement comprising an extremely long roll period, it is also possible to impart several reciprocating movements between said extreme positions $\mathbf{4}_a$ and $\mathbf{4}_b$ to the stabilisation element during said roll period, with the direction of rotation of the stabilisation element changing with every movement from position $\mathbf{4}_a$ to $\mathbf{4}_b$, and vice versa.

This results in a more of functional control with a greater effective damping of the long rolling motion.

Figure 3:
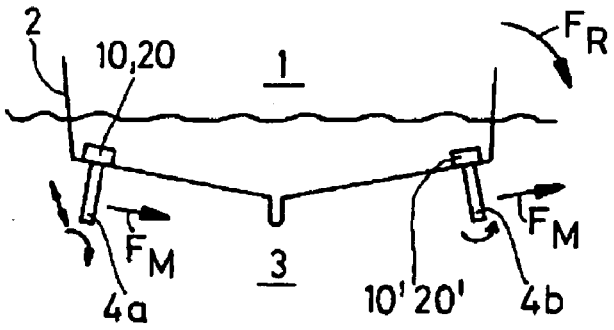
FIG. 3 is a general view of a ship fitted with an active roll stabilisation system according to the invention.
Figure 7A:
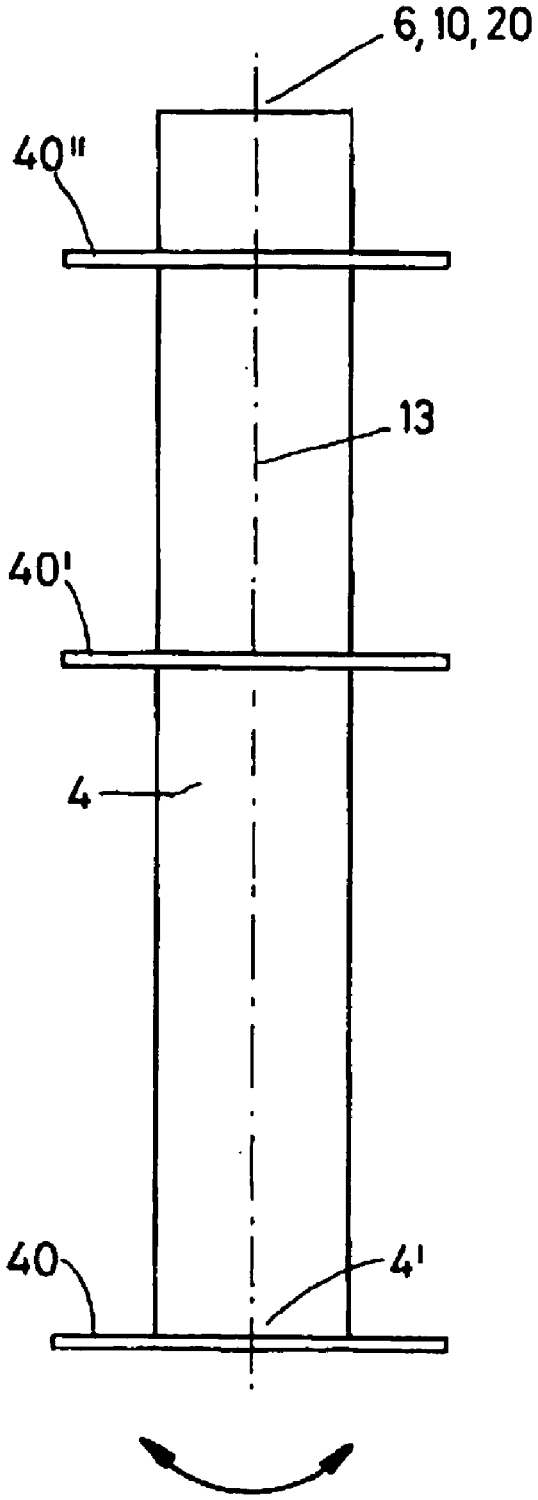
FIGS. 7A–7B are views of a detail of an active roll stabilisation system according to the invention.
Figure 7B:
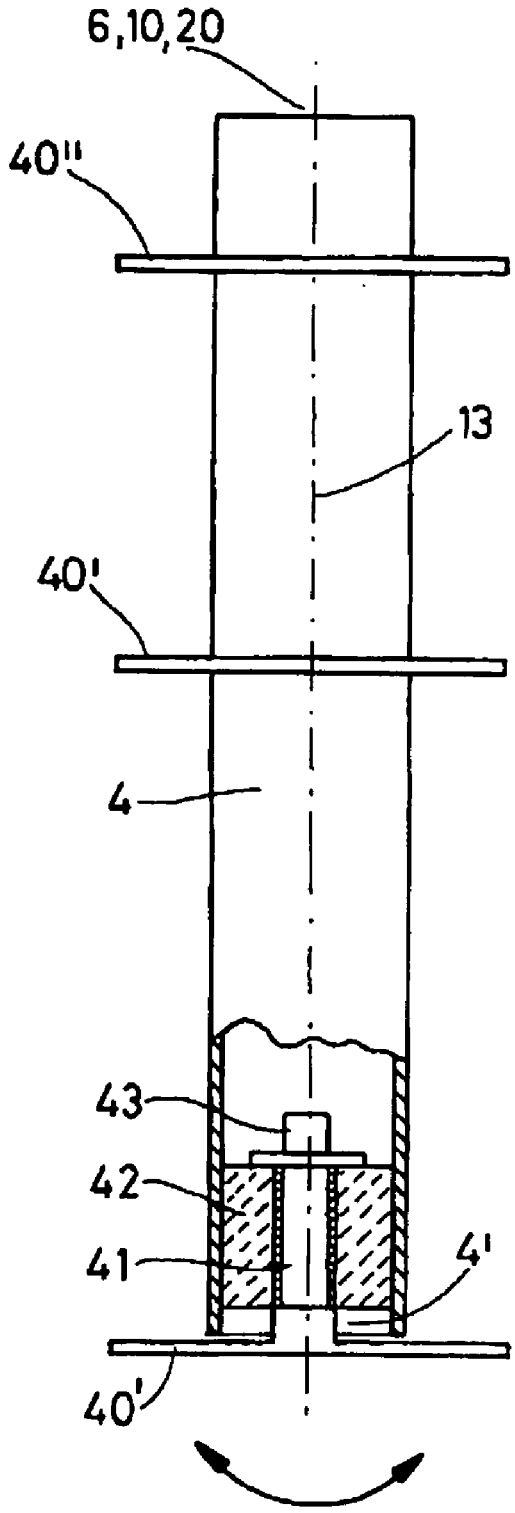

FIGS. 7A and 7B show two further detail views of a rotatable stabilisation element 4 according to the invention, which can be used with the translating embodiment as shown in FIGS. 2A–3 or with the pivoted embodiment as shown in FIG. 4, 5A–5E.

In these two embodiments, the stabilisation element moves through the stagnant water 3 with its free end 4', with the peripheral velocity of the free end 4' of the stabilisation element 4 being greatest in particular in the case of the pivoted embodiment that is shown in FIGS. 4, 5A–5E. As a result, the hydrodynamic effects that occur near the free end 4' are comparable to the aerodynamic effects that occur near the wing tips of an aeroplane or near the ends of a windmill rotor.

Said hydrodynamic effects can be comparted to the turbulence at the tips of an aircraft wing and a windmill rotor as referred to above, which turbulent flows near the free end 4' result in a circumfluence of the medium (water in this case) from the side of the moving and rotating stabilisation element where the high pressure prevails to the side of he stabilisation element 4 where a low pressure prevails.

Said circumfluence near the free end 4' of the stabilisation element 4 reduces the lift of the moving and rotating stabilisation element, which functions as a wing, and consequently it also reduces the corrective force $F_M$ being generated as a result of the Magnus force. According to the invention, in order to prevent said circumfluence of medium from the high-pressure side to the low-pressure side around the free end 4' of the stabilisation element 4, a plate member 40 is mounted to the free end 4', which plate member extends perpendicularly to the longitudinal axis 13 of the stabilisation element 4.

In FIG. 7A, the plate member 40 is fixedly connected to the free end 4' of the stabilisation element 4, and consequently it will rotate along with the stabilisation element at the same rotational speed as imparted by the driving means 6. Although it has been established by experiment that the circumfluence of medium from the high-pressure side to the low-pressure side of the free end 4' is significantly reduced in this manner, and thus contributes positively to the eventual lift of the stabilisation element 4 (and consequently to a stronger Magnus force $F_M$ for damping or compensating the ship's movements), the plate member 40 that rotates along with the stabilisation element also "cuts" through the water, as a result of which the rotating stabilisation element 4 is slightly decelerated.

To eliminate or compensate for this phenomenon, it is proposed in the embodiment as shown in FIG. 7B to mount the plate member 40' to the free end 4' of the stabilisation element 4 by means of a bearing 42. To that end, the plate member 40' comprises a projecting shaft member 41, which can be accommodated in the bearing 42 and which can be mounted to the free end 4' of the stabilisation element by means of a connecting element 43 (for example a screw bolt) in such a manner that the rotary motion of the stabilisation element 4 as imparted by the driving means 6 is not transmitted to the plate member 40'. With this embodiment, no rotary interaction occurs between the plate member 40' and the surrounding water 3, and the damping influence of the water on the plate member is prevented.

In order to prevent the pressure difference occurring on one side of the stabilisation element from resulting in a circumfluence of water along the surface of the element 4, one or more plates 40'–40" may be provided in the longitudinal direction (perpendicularly thereto).

Figure 8A:
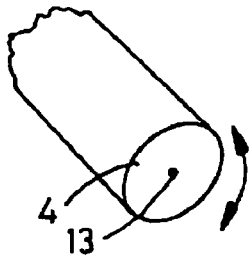
FIGS. 8A–8F are views of further details of an active roll stabilisation system according to the invention.
Figure 8B:
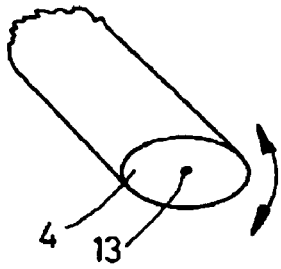
Figure 8C:
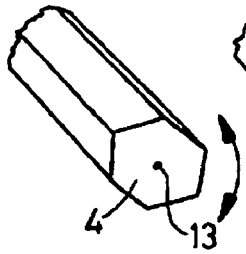
Figure 8D:
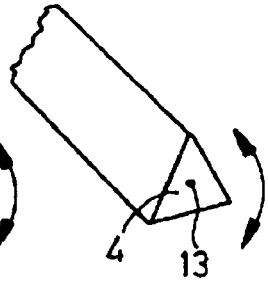

In FIGS. 8A–8F specific embodiments of the stabilisation element 4 for use in the active roll stabilisation system according to the invention are shown. Generally, the stabilisation element is either of symmetrical or of asymmetrical cross-section. In FIG. 8A, the stabilisation element 4 has a symmetrical, polygonal cross-sectional shape, viz. a cylindrical shape, whilst in FIG. 8B the stabilisation element 4 has an asymmetrical, oval cross-section. FIGS. 8C and 8D furthermore show the polygonal, octogonal or triangular cross-sectional shape.

Figure 8E:
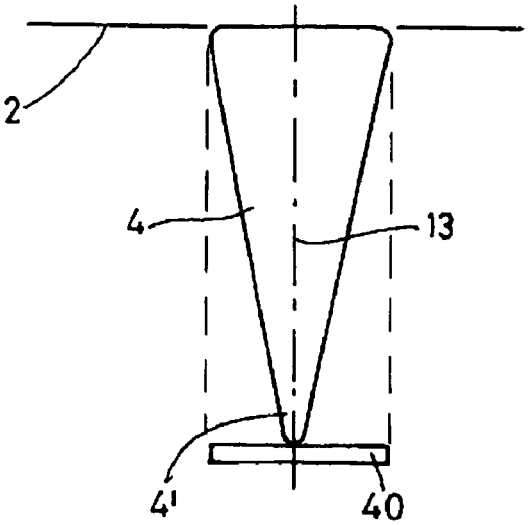
Figure 8F:
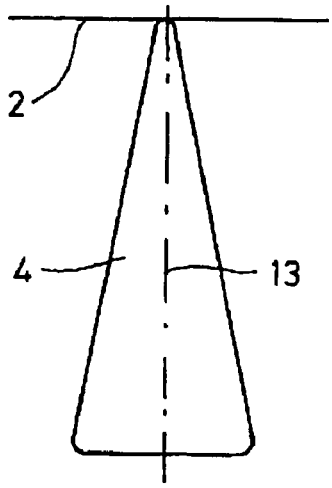

Yet another very functional embodiment of the stabilisation element 4 as used in the active roll stabilisation system according to the invention has a conical shape, with the stabilisation element 4 narrowing in its longitudinal direction 13 towards its free end 4', seen from the ship's hull 2, as shown in FIG. 8E, or being narrow near the ship's hull and widening towards the free end 4', as shown in FIG. 8F. In FIG. 8E the conical stabilisation element 4 is provided with a plate 40 at its free end 4', similar to the embodiment that is shown in FIGS. 7A and 7B.

In another embodiment, the outer surface 4*h* is roughened so as to obtain an increase in area. Said increase in area has a favourable hydrodynamic effect on the water 3 flowing past, and in particular on the vortex (i.e. the wake of the water 3 flowing past the stabilisation element 4) directly behind the stabilisation element (indicated by reference Y). The effectiveness of the stabilisation element 4 is thus influenced in a favourable manner.

Figure 9A:
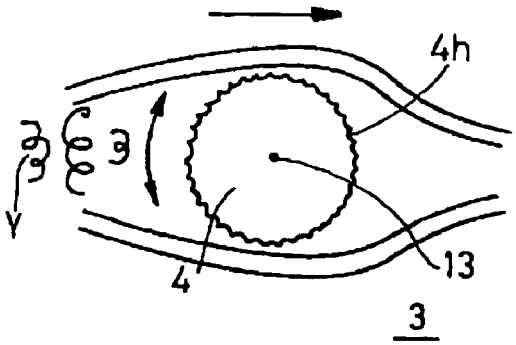
FIGS. 9A–9B are views of further details of an active roll stabilisation system according to the invention.
Figure 9B:
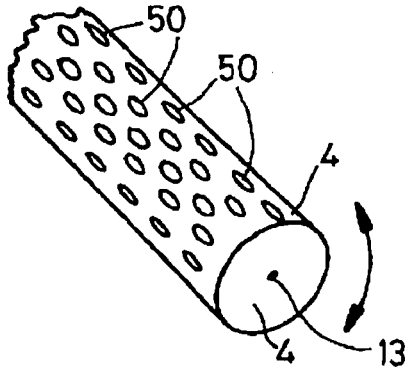

FIG. 9B shows another functional embodiment of the stabilisation element as used in the active roll stabilisation system according to the invention, in which the outer surface 4*h* of the stabilisation element 4 is provided with a large number of indentations 50. This form of surface roughening has a similar positive effect on the hydrodynamic phenomena that occur during the movement of the rotating stabilisation element 4 through the water, and thus contributes positively to the lift of the stabilisation element 4 and the correction forces thus created as a result of the Magnus effect.

Although mention is made of the use of one stabilisation element in all the embodiments discussed herein, it is preferable to mount such a stabilisation element on either longitudinal side of the ship.

What is claimed is:

1. An active roll stabilization system for ships, comprising:

at least one rotatable stabilization element extending below the water line;

driving means for rotating the stabilization element for the purpose of damping the ship's movements that are being sensed; and sensor means for sensing the ship's movements and delivering control signals on the basis thereof to said driving means, wherein the system furthermore comprises displacement means for moving the stabilization element with respect to the hull of a ship based on the control signals delivered by the sensor means.

2. An active roll stabilization system according to claim 1, wherein the ship has a longitudinal direction and the moving stabilization element comprises a motion component in the longitudinal direction of the ship.

3. An active roll stabilization system according to claim 1, wherein the displacement means impart a translating movement to the stabilization element with respect to the ship's hull.

4. An active roll stabilization system according to claim 3, wherein the stabilization element is accommodated in a guide mounted in or on the ship's hull.

5. An active roll stabilization system according to claim 4, wherein the ship has a longitudinal direction and the guide extends at least partially in the longitudinal direction of the ship.

6. An active roll stabilization system according to claim 1, wherein the displacement means impart a pivoting movement to the stabilization element with respect to the ship's hull.

7. An active roll stabilization system according to claim 6, wherein the stabilization element is connected to the ship by means of a universal joint.

8. An active roll stabilization system according to claim 6, wherein the stabilization element can be accommodated in a recess formed in the ship's hull.

9. An active roll stabilization system according to claim 6, wherein the displacement means comprise at least one arm, to which the stabilization element is mounted.

10. An active roll stabilization system according to claim 9, wherein said arm is connected to the ship by means of a universal joint.

11. An active roll stabilization system according to claim 1, wherein the stabilization element comprises at least one rotatable, elongated shaft.

12. An active roll stabilization system according to claim 11, wherein the stabilization element comprises two rotatable, elongated, interconnected shafts positioned some distance apart.

13. An active roll stabilization system according to claim 12, wherein the two shafts are interconnected by means of an endless carrier mounted over the shafts.

14. An active roll stabilization system according to claim 1, wherein the stabilization element is of symmetrical cross-section.

15. An active roll stabilization system according to claim 14, wherein the stabilization element is of polygonal cross-section.

16. An active roll stabilization system according to claim 1, wherein the stabilization element is of asymmetrical cross-section.

17. An active roll stabilization system according to claim 1, wherein the stabilization element is of conical shape, seen in a longitudinal direction.

18. An active roll stabilization system according to claim 1, wherein the stabilization element has a roughened outer surface.

19. An active roll stabilization system according to claim 18, wherein the outer surface of the stabilization element comprises a large number of indentations.

20. An active roll stabilization system according to claim 1, wherein the stabilization element is provided with at least one plate extending perpendicularly to the axis of rotation.

21. An active roll stabilization system according to claim 20, wherein said plate is mounted to the end of the stabilization element.

22. An active roll stabilization system according to claim 21, wherein said plate is mounted to the free end of the stabilization element by means of a bearing.

23. An active roll stabilization system according to claim 1, wherein the ship has first and second longitudinally extending sides and a the stabilization element is provided on either longitudinally-extending side of the ship.

* * * * *